US005205924A

United States Patent [19]

Betts et al.

[11] Patent Number: 5,205,924

[45] Date of Patent: Apr. 27, 1993

[54] TRANSFER LINE QUENCHING PROCESS AND APPARATUS

[75] Inventors: Paul J. Betts, Rockville Centre, N.Y.; Frank M. Buyan, Yardley, Pa.

[73] Assignee: Mobil Oil Corporation, Fairfax, Va.

[21] Appl. No.: 729,136

[22] Filed: Jul. 12, 1991

[51] Int. Cl.[5] ..... C10G 9/16; C10G 9/18; C10G 11/00

[52] U.S. Cl. ..... 208/113; 208/48 Q; 208/157

[58] Field of Search ..... 208/48 Q, 113, 157

[56] References Cited

U.S. PATENT DOCUMENTS 3,338,821 8/1967 Moyer et al. ..... 208/48 Q
4,980,051 12/1990 Owen ..... 208/113
5,019,239 5/1991 Owen ..... 208/48 Q
5,043,058 8/1991 Forgac et al. ..... 208/48

*Primary Examiner*—Theodore Morris
*Assistant Examiner*—P. L. Hailey
*Attorney, Agent, or Firm*—Alexander J. McKillop; Malcolm D. Keen; Richard D. Stone

[57] ABSTRACT

A process and apparatus for fluidized catalytic cracking of heavy oils is disclosed. The long transfer line connecting the catalytic cracking reactor to the main fractionator is modified by incorporation of a quench zone, of enlarged cross sectional area, where liquid products are recycled from the main fractionator and injected into the transfer line, without wetting the walls of the transfer line near the reactor outlet. Quenching hot cracked products from the FCC reactor in the transfer line, improves yields, and permits higher catalytic cracking reactor temperatures.

16 Claims, 3 Drawing Sheets

TRANSFER LINE QUENCHING PROCESS AND APPARATUS

BACKGROUND OF THE INVENTION

1. Field of the Invention

The field of the invention is catalytic cracking of heavy hydrocarbon oils to lighter products in general, and unfavorable reactions occurring in a transfer line connecting the cracking reaction zone and a fractionator associated therewith, in particular.

2. Description of Related Art

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In moving bed cracking, the catalyst is in bead form. Feed contacts a moving bed of bead catalyst and is cracked into lighter products. The lighter products are removed from the reactor and charged via a transfer line to a distillation column, sometimes called the synthetic crude tower (Syntower) or the main column. In some moving bed units, the reactor effluent vapors were cooled in the transfer line just upstream of the main column, by injection of a recycle stream from the main column. The reactor effluent was cooled so that no superheated vapor would enter the column. Enough liquid was introduced into the transfer line just upstream of the main column to cool the effluent and produce a two phase mixture, which was charged to the base of the main column. Usually the liquid was injected by a single spray nozzle, which moved a lot of liquid into the transfer line, but did only a fair job of contacting the liquid spray with the hot vapor.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.-600° C., usually 460° C.-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Zeolite-containing catalysts having high activity and selectivity are now used in most FCC units. These catalysts work best when coke on the catalyst after regeneration is less e.g., less than 0.3 wt.

To regenerate FCC catalysts to these low residual carbon levels, and to burn CO completely to CO2 within the regenerator (to conserve heat and minimize air pollution) many FCC operators add a CO combustion promoter metal to the catalyst or to the regenerator.

U.S. Pat. Nos. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

Modern, zeolite based catalyst are so active that the heavy hydrocarbon feed can be cracked to lighter, more valuable products in much less time. Instead of dense bed cracking, with a hydrocarbon residence time of 20–60 seconds, much less contact time is needed. The desired conversion of feed can now be achieved in much less time, and more selectively, in a dilute phase, riser reactor.

Riser cracking is more selective than dense bed cracking. Refiners maximized riser cracking benefits, but in so doing induced, inadvertently, a significant amount of thermal cracking. Thermal cracking is not as selective as either riser cracking or dense bed cracking, and most refiners would deny doing any thermal cracking, while building and operating FCC units with all riser cracking which also did a significant amount of thermal cracking.

Thermal cracking was a by-product of upflow riser reactors, which discharged cracked products more than 100 feet up, and product fractionators which charged the hot vapors from the FCC unit to the bottom of the main column. The transfer lines to connect the FCC kept getting longer, and the material exiting the riser reactor kept getting hotter, and the combination caused thermal cracking. The trend to heavier feeds only made things worse. Higher temperatures were sought to crack the heavy feed, and the heavy feeds contained more highly aromatic material that wanted to thermally degrade to form coke or other undesired species.

The reasons for high risers in FCC, and for adding hot vapor to the bottom of the FCC main column will be briefly reviewed. After this, some other work on minimizing thermal cracking in riser cracking FCC units will be reviewed.

Risers are tall because of high vapor velocities and residence time. The FCC riser operates in dilute phase flow. There is better distribution of catalyst across the riser when vapor velocities are fairly high. Many FCC riser reactors now operate with vapor velocities on the order of 20–50 feet per second. To achieve enough residence time in the riser, the riser must be very tall. For a 2 second hydrocarbon residence time, the riser must be at least 100 feet long with a 50 fps vapor velocity. There usually must be addition space provided at the base of the riser reactor to add catalyst and more space for feed nozzles. The cracked vapor products exit the riser and enter a reactor vessel, at an elevation more than 100 feet in the air, for separation of spent catalyst from cracked products, usually in one or more stages of cyclone separation. The cracked products are eventually discharged, usually up, from the separation section, usually at an elevation well above the top of the riser, and charged to the base of the main column.

Hot vapors from the FCC unit are charged to the base of the main column for several reasons, but primarily so that the hot vapors may be used to heat the column. Another reason is that the hot vapors always contain some catalyst and catalyst fines, which are never completely removed in the FCC reactor, despite the use of multiple stages of cyclone separators. Adding the fines laden vapor to the bottom of the main column at least minimizes amount of fines that must circulate through the column. The fines are largely confined to the very base of the column. The lower trays or packing of the main column are designed to tolerate the fines by using sloping trays that permit fines to drain or be swept from a tray without clogging it.

The combination of high temperatures in the riser reactor, a tall riser reactor, and a bottom fed main column, give enough residence time to cause a significant amount of thermal cracking to occur.

As the process and catalyst improved, refiners attempted to use the process to upgrade a wider range of feedstocks, in particular, feedstocks that were heavier.

These heavier, dirtier feeds have placed a growing demand on the reactor and on the regenerator. Processing resids exacerbated existing problem areas in the riser reactor, namely feed vaporization, catalyst oil contact, accommodation of large molar volumes in the riser, and coking in the transfer line from the reactor to the main fractionator. Each of these problem areas will be briefly discussed.

Feed vaporization is a severe problem with heavy feeds such as resids. The heavy feeds are viscous and difficult to preheat in conventional preheaters. Most of the heating and vaporization of these feeds occurs in the base of the riser reactor, where feed contacts hot, regenerated catalyst. Because of the high boiling point, and high viscosity, of heavy feed, feed vaporization takes longer in the riser, and much of the riser length is wasted in simply vaporizing feed. Multiple feed nozzles, fog forming nozzles, etc., all help some, but most refiners simply add more atomizing steam. Use of large amounts of atomizing steam helps produce smaller sized feed droplets in the riser, and these smaller sized drops are more readily vaporized. With some resids, operation with 3-5 wt % steam, or even more, approaching in some instances 5-10 wt % of the resid feed, is needed to get adequate atomization of resid. All this steam helps vaporize the feed, but wastes energy because the steam is heated and later condensed. It also adds a lot of moles of material to the riser. The volume of steam approaches that of the volume of the vaporized resid in the base of the riser. This means that up to half of the riser volume is devoted to steaming (and deactivating) the catalyst, rather than cracking the feed.

In many FCC units better feed vaporization is achieved by using a higher temperature in the base of the riser reactor, and quenching the middle of the riser or the riser outlet.

Catalyst/oil contact is concerned with how efficiently the vaporized feed contacts catalyst in the riser. If feed vaporization and initial contacting of catalyst and oil is efficient, then catalyst/oil contact will tend to be efficient in the rest of the riser as well. High vapor velocities, and more turbulent flow, promote better contact of catalyst and oil in the riser. High superficial vapor velocities in the riser mean that longer risers are required to achieve the residence time needed to attain a given conversion of heavy feed to lighter components.

Large molar volumes are sometimes a problem when processing resids. This is because the heavy feeds, with an extremely high molecular weight, occupy little volume when first vaporized, but rapidly crack to produce a large molar expansion. Large amounts of vaporization steam add to the volume of material that must be processed in the riser, and addition of quench material to the riser, or to the riser outlet, all increase the volume of material that must be handled by the main column. More volume does not usually translate into reduced residence time in the transfer line connecting the cracked vapor outlet near the top of the FCC riser to the base of the main column. This is because refiners usually limit the vapor velocity in large vapor lines to about 120 to about 150 feet per second. Vapor velocities below this are used for several reasons, but primarily to control erosion and limit pressure drop. Erosion is a problem because of the presence of catalyst fines. Pressure drop is a problem, because it takes a lot of energy to transfer large volumes of material through a large pressure drop. High pressure drops in this transfer line, the line to the main column, would also increase the FCC reactor pressure, which is undesirable from a yield standpoint, and decrease the main column pressure which increases the load on the wet gas compressor associated with the main column.

Coking in the transfer lines connecting the FCC reactor vapor outlet with the main column refers to coke formation in this transfer line. FCC operators have long known that "dead spaces" in a line could lead to coke formation. Coke formation is a frequently encountered problem in the "dome" or large weldcap which forms the top of the vessel housing the riser reactor cyclones. If oil at high temperature is allowed to remain stagnant for a long time, it will slowly form coke. For this reason refiners have routinely added a small amount of "dome steam", typically 500 #/hr, to prevent formation of coke in the dome of an FCC unit. Coking in the transfer line is somewhat related, in that coke will form in stagnant or dead areas of the transfer line. Coke will also form if there are cool spots in the transfer line. The cool spots allow some of the heaviest material in the reactor effluent vapor to condense. These heavy materials, some of which may be entrained asphaltenic materials, will form coke if allowed to remain for a long time in the transfer line. Thus refiners have tried to insulate the transfer line to the main column, not only to prevent heat loss to the atmosphere, but also to prevent coking in this line. The problem of coke formation gets more severe with either an increase in reactor/transfer line temperatures, or with a decrease in feed quality so that it contains more heavier materials.

Although great strides have been taken to improve many parts of the FCC process, such as better regenerators, better catalyst strippers, and better catalysts, the process has not been able to realize its full potential, especially with heavy feedstocks including non-distillable materials.

These trends, to high temperatures and high vapor velocity in the riser, and tall risers, all improved the cracking process and provided better yields of cracked products. These trends allowed FCC units to process significantly heavier feeds. These trends also caused unselective thermal cracking of the valuable cracked products, and increased the amount of energy needed to move cracked products from the reactor to the main column.

We examined the work that others had done, and realized that it was time for a new approach. We wanted the benefits of short residence time riser cracking, without the unselective thermal cracking, coke formation in transfer lines, and excessive energy consumption associated with the conventional way of recovering cracked products from a FCC riser reactor vapors.

We wanted to be able to modify existing units to eliminate transfer line coking or transfer line thermal reactions, without completely rebuilding the unit. We needed to cool the reactor effluent vapor, but not waste the heat contained in the effluent vapor stream. We also wanted a system that would be reliable, could operate for years, be fail safe so that if it broke the unit could continue to operate, and that would not promote coking.

Some work was done on cooling FCC transfer lines, for different reasons. Moyer U.S. Pat. No. 3,338,821 was an FCC case, with quench just downstream of the FCC reactor. A primary reason for quenching was to reduce vapor velocity in the transfer line so that the high velocity stream of vapor and entrained FCC catalyst wouldn't wear a hole in the transfer line. Moyer was concerned that "the unavoidably entrained catalyst . . . at a tremendously high velocity . . . is undesirable because the finely divided particles of catalyst will erode the . . . conduit to a degree that frequent repairs are necessary." Col 1. lines 48–58. Moyer quenched to reduce vapor velocities in the transfer line. This also quenched the transfer line. At the relatively lower temperatures, and with the distillable feeds used, coke formation in the transfer line was not a problem. With higher reactor temperature feeds, and feeds (and products) containing more resid, the approach shown could cause transfer line coking. Wetting the hot wall of the transfer line with quench liquid would give the liquid enough residence time to form "coke".

We believed that the problems of transfer line reactions could be solved with quench injection in the transfer line, provided a way could be devised to prevent wetting the transfer line at the point of quench injection. We wanted to retain the low pressure drop, and relatively low cost, associated with in-line, preferably co-current quench, but wanted to avoid forming a liquid film on any portion of the transfer line which was hot enough to cause coking.

BRIEF SUMMARY OF THE INVENTION

Accordingly, the present invention provides in a fluidized catalytic cracking process wherein a heavy hydrocarbon feed comprising hydrocarbons having a boiling point above about 650° F. is catalytically cracked to cracked products comprising the steps of: catalytically cracking said feed in a catalytic cracking zone operating at catalytic cracking conditions by contacting said feed with a source of hot regenerated cracking catalyst to produce a cracking zone effluent mixture having an effluent temperature and comprising cracked products and spent cracking catalyst containing coke and strippable hydrocarbons; separating said cracking zone effluent mixture into a cracked product vapor phase having a temperature above 900° F. and a spent catalyst rich phase; stripping and regenerating said spent catalyst to produce regenerated catalyst which is recycled to crack heavy feed; transferring said cracked product vapor from said catalytic cracking zone to a main fractionator which recovers liquid product fractions from said cracking zone effluent via a transfer line having a cross sectional area and an upstream portion near said cracking zone and a downstream portion near said main fractionator at a transfer line temperature above 900° which is sufficient to cause thermal cracking of said cracked vapor product in said transfer line; quenching in a quench zone, comprising a portion of the transfer line having a cross sectional area at least 25% greater than the cross sectional area of the transfer line near said cracking zone, in the upstream portion of said transfer line said cracked product vapor by injection of a liquid product fraction recycled from said main fractionator into said transfer line in an amount and at a temperature sufficient to reduce the temperature of the cracked product vapor in said transfer line by at least 30° F. and to vaporize at least 90% of the injected product liquid, wherein the amount of thermal cracking, as measured by Equivalent Reaction Time at 800° F., in said transfer line is reduced by at least 50%.

In an apparatus embodiment, the present invention provides an apparatus for the fluidized catalytic cracking of a heavy hydrocarbon feed comprising hydrocarbons having a boiling point above about 650° F. to lighter products by contacting said feed with catalytic cracking catalyst comprising: a catalytic cracking riser reactor means having an inlet in a lower portion of the riser connective with a source of said feed and with a source of hot regenerated catalyst and having an outlet at an upper portion of the riser for discharging a cracking zone effluent mixture comprising cracked products and spent cracking catalyst; a separation means within a vessel containing the riser reactor outlet adaptive to separate said cracking zone effluent mixture into a cracked product vapor phase which is removed from said vessel via a vessel vapor outlet and a spent catalyst rich phase which is conveyed to a stripping means; a stripping means for stripping spent catalyst which is operatively connected with said separations means for admission of spent catalyst and discharges a stream of stripped catalyst: a catalyst regeneration means connective with said stripping means for regenerating the stripped catalyst to produce regenerated catalyst and comprising means for recycling regenerated cracking catalyst to the base of the riser reactor; a transfer line having a cross sectional area and an upstream portion connective with the vessel cracked product vapor outlet and a downstream portion connective with a main fractionator means for transfer of cracked vapor to a main fractionator means for fractionation and recovery of liquid streams of cracked products; a quench means located within the upstream portion of the transfer line, said quench means comprising a portion of the transfer line having a cross sectional area at least 25% greater than the cross sectional area of the transfer line near said cracking zone, and further comprising means for injection of at least one quench liquid stream from the main fractionator into said transfer line whereby cracked products removed from the vessel vapor outlet are contacted with quench liquid from the main fractionator in said quench region having an enlarged cross sectional area.

DETAILED DESCRIPTION

Figure 1:
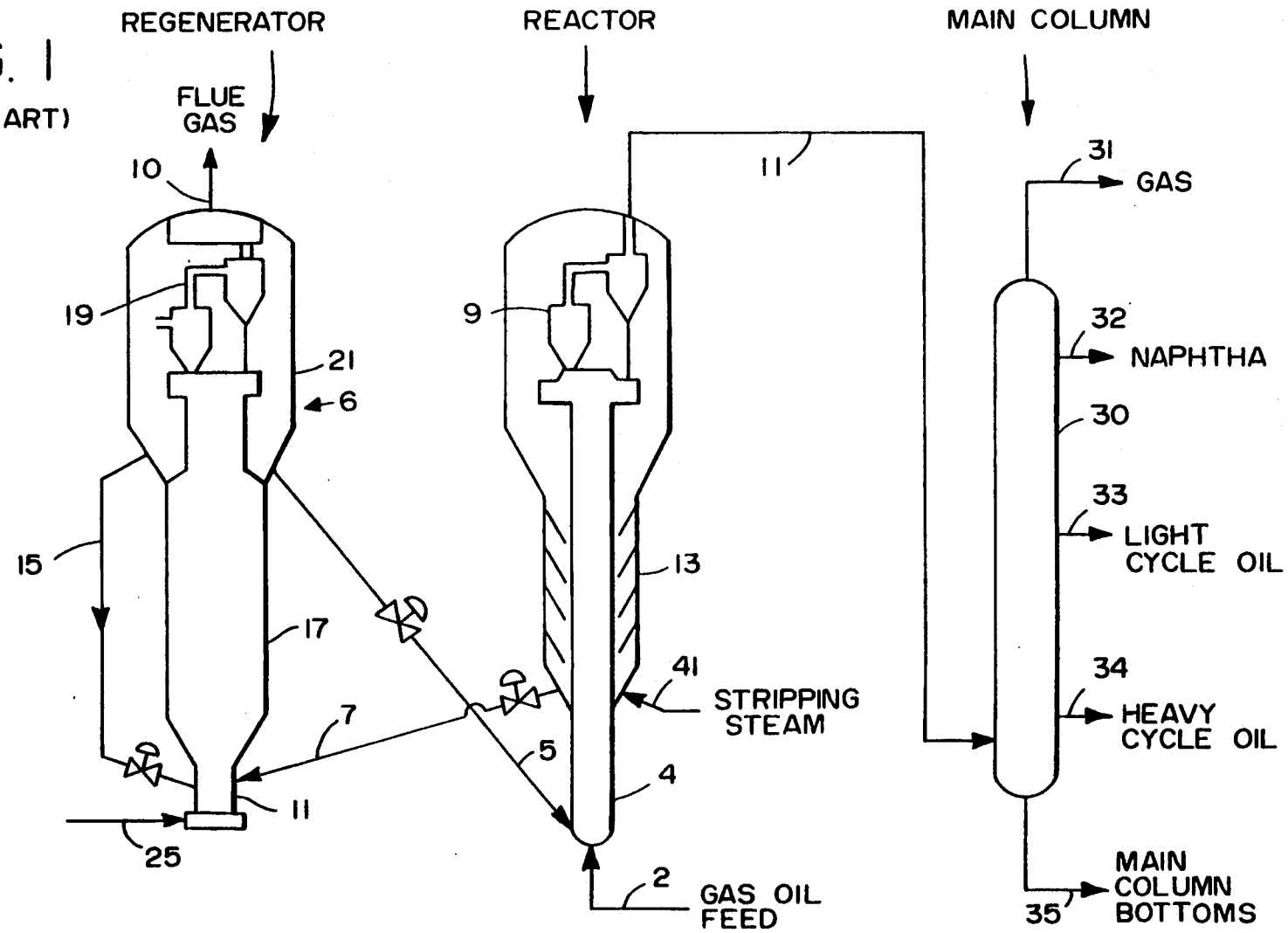
FIG. 1 (PRIOR ART)
FIG. 1 (prior art) is a simplified schematic view of an FCC unit of the prior art, with all riser cracking, and a transfer line from the riser reactor to the main column.

The present invention can be better understood by reviewing it in conjunction with the conventional way of operating an all riser cracking FCC unit. FIG. 1 illustrates a fluid catalytic cracking system of the prior art. It is a simplified version of FIG. 1 or U.S. Pat. No. 4,421,636, which is incorporated herein by reference.

A heavy feed, typically a gas oil boiling range material, is charged via line 2 to the lower end of a riser cracking FCC reactor 4. Hot regenerated catalyst is added via conduit 5 to the riser. Preferably, some atomizing steam is added, by means not shown, to the base of the riser, usually with the feed. With heavier feeds, e. g., a resid, 2–10 wt. % steam may be used. A hydrocarbon-catalyst mixture rises as a generally dilute phase through riser 4. Cracked products and coked catalyst are discharged from the riser. Cracked products pass through two stages of cyclone separation shown generally is 9 in the figure.

The riser 4 top temperature, which usually is the same as the temperature in conduit 11, ranges between about 480° and 615° C. (900° and 1150° F.), and preferably between about 538° and 595° C. (1000° and 1050° F.). The riser top temperature is usually controlled by adjusting the catalyst to oil ratio in riser 4 or by varying feed preheat.

Cracked products are removed from the FCC reactor via transfer line 11 and charged to the base of the main column 10. In some refineries, this column would be called the Syncrude column, because the catalytic cracking process has created a material with a broad boiling range, something like a synthetic crude oil. The main column 10 recovers various product fractions, from a heavy material such as main column bottoms, withdrawn via line 35 to normally gaseous materials, such as the vapor stream removed overhead via line 31 from the top of the column. Intermediate fractions include a heavy cycle oil fraction in line 34, a light cycle oil in line 33, and a heavy naphtha fraction in line 32.

Cyclones 9 separate most of the catalyst from the cracked products and discharges this catalyst down via diplegs to a stripping zone 13 located in a lower portion of the FCC reactor. Stripping steam is added via line 41 to recover adsorbed and/or entrained hydrocarbons from catalyst. Stripped catalyst is removed via line 7 and charged to a high efficiency regenerator 6. A relatively short riser-mixer section 11 is used to mix spent catalyst from line 7 with hot, regenerated catalyst from line 15 and combustion air added via line 25. The riser mixer discharges into coke combustor 17. Regenerated catalyst is discharged from an upper portion of the dilute phase transport riser above the coke combustor. Hot regenerated catalyst collects as a dense phase fluidized bed, and some of it is recycled via line 15 to the riser mixer, while some is recycled via line 5 to crack the fresh feed in the riser reactor 4. Several stages of cyclone separation are used to separate flue gas, removed via line 10.

Thermal cracking degrades the cracked product removed via line 11. The average residence time in the transfer line between the FCC reactor outlet and the main column is usually in excess of 10 seconds, although some units operate with a shorter vapor residence times.

The temperature in this line is usually the riser outlet temperature. The combination of time and temperature is enough to cause a significant amount of unselective, and unwanted, thermal cracking upstream of the main column.

There is an additional problem with the prior art design when it is used to crack feeds containing more than 10% non-distillable feeds, or when the feed contains relatively high levels of Conradson Carbon Residue, e.g., exceeding 2, 3, 5 and even 10 wt % CCR. This additional problem is coke formation in the transfer line. It is somewhat related to thermal cracking, but becomes a severe problem only when heavier feedstocks are being cracked. It may be due to carryover of uncracked asphaltenic material, or thermal degradation or polymerization of large aromatic molecules into coke or coke precursors.

Polymerization, or coking in the transfer line need not involve a large fraction of the cracked product to cause a problem with product purity or plugging of the transfer line or the main column. Phrased another way, coking in the unit could shut the unit down, but need not be noticeable in yields. Thermal cracking in the transfer line will cause a significant yield loss, but will not automatically cause coking or plugging of the transfer line. Fortunately both problems are overcome by the process of the present invention, which will be discussed in conjunction with FIG. 2.

Figure 2:
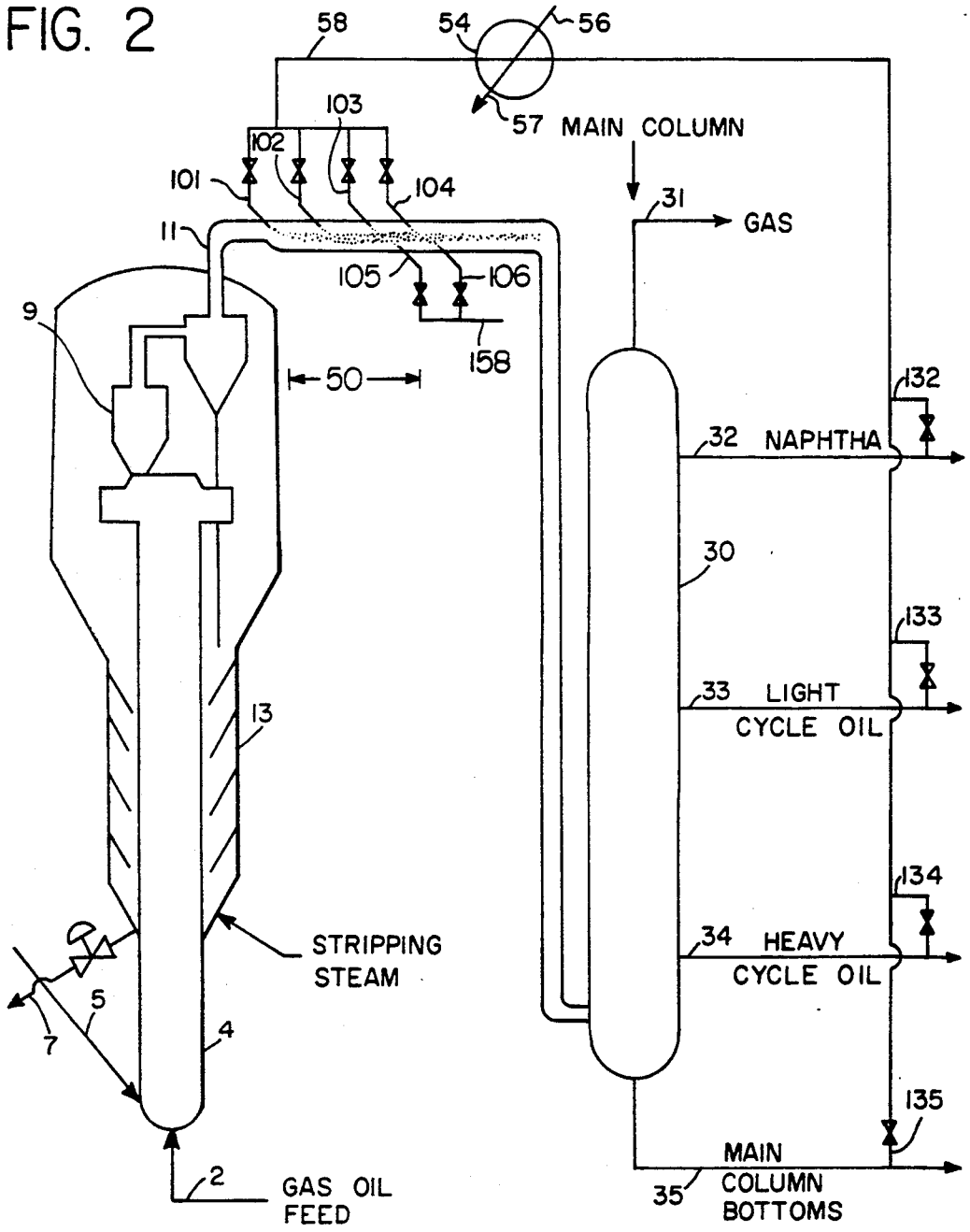
FIG. 2 is a simplified schematic view of an FCC unit of the invention, with a quench zone in a transfer line having an increased diameter downstream portion from the reactor outlet to the main column.

FIG. 2 shows one embodiment of the present invention. Most of the elements in FIG. 2 are identical to those in FIG. 1, and like elements, such as main column 10, have like reference numerals in both figures.

As in the FIG. 1 embodiment, a heavy feed, preferably containing more than 10% residual or non-distillable material, is cracked in riser cracker 4. Cracked products are discharged from the riser, pass through two stages of cyclone separation 9 and are discharged via line 11 from the FCC reactor.

The cracked vapors are immediately cooled in enlarged quench zone 50, which is part of the transfer line 11 just downstream of the FCC reactor section. Hot cracked hydrocarbon vapors in line 11 contact a quench liquid which is recycled from the main column. The quench liquid can be any fluid which is compatible with the cracked vapor product, but preferably is a liquid derived from the main column. It is essential that the quench zone have an enlarged diameter, relative to the transfer line upstream of the quench zone. This allows the quenching liquid to be sprayed into the transfer line, while minimizing wetting of the transfer line where temperatures are high enough to cause coking.

The quench liquid can be a main column bottoms stream obtained via line 135, a heavy cycle oil stream from line 134, a light cycle oil from line 133 a naphtha fraction from line 132, or even a normally gaseous liquid stream derived from 31. These quench streams, or a mixture thereof, may be passed through optional cooler 54. Cooler 54 heat exchanges hot liquid from the main column with a cooler heat exchange fluid, added relatively cool via line 56 and removed relatively warmer via line 57. Cooler 54 can comprise multiple heat exchangers, in series or in parallel. Cooler 54 can be used to generate steam for use in power generation or in the refinery steam supply.

The quench liquid, if cooled, is removed from heat exchanger 54 via line 58 and added to the transfer line 11 via liquid addition means shown generally as 101, 102, 103, 104. Much conventional equipment, such as pumps, control valves, thermocouples, etc. has been omitted. Quench liquid may be added from the top of the transfer line, as shown, or from the bottom via liquid addition means 105 and 106 connective with a source of quench liquid in line 158.

Preferably spray nozzles, or other efficient liquid distribution system, is used to distribute quench liquid across the cross-sectional area of quench zone 50 in line 11.

The transfer line downstream of quench zone 50 can have the same or larger diameter as the diameter of the quench zone in region 50, or the diameter may be the same as line 11. Once the superheated vapor is quenched, and the sidewalls of the transfer line cooled somewhat by the flowing vapor, the transfer line diameter is no longer critical and can be sized to accommodate the flow therethrough.

It may be beneficial to control the amount and manner of quench liquid addition so that all of the quench liquid vaporizes, and none of the reactor effluent vapors condense. This will keep everything in the transfer line 11 in the vapor phase, and eliminate problems of slugging, etc.

It will frequently be preferred to add quench liquid somewhat in excess, and ensure some condensation, or failure to vaporize of at least some of the quench liquid. This will introduce concerns about slugging, increased weight in the line due to the presence of a liquid phase, but will ensure desuperheating of the material in the transfer line.

On balance, it is probably best to add slightly too much quench liquid (ensuring some condensation in the line) than too little (the approach requiring all the liquid added to be vaporized. Regardless of the approach—total vaporization of quench liquid to ensure liquid flow, or sufficient quench to cause some condensation—it is essential to enlarge the diameter of the transfer line at the point where quench liquid is injected so that the quench liquid will not wet or splash on hot metal surfaces near the reactor outlet. The enlarged transfer line allows the quench liquid to cool the reactor effluent, and the cooled reactor effluent cools the hot surface of the transfer line.

Although not shown in the drawing, it is possible to provide means for collecting quench liquid in zone 50 and recycling it or removing it. A dam, or Yorkmesh mist eliminator may be used alone or together to help recover mist or liquid which escapes the quench zone 50.

Figure 3:
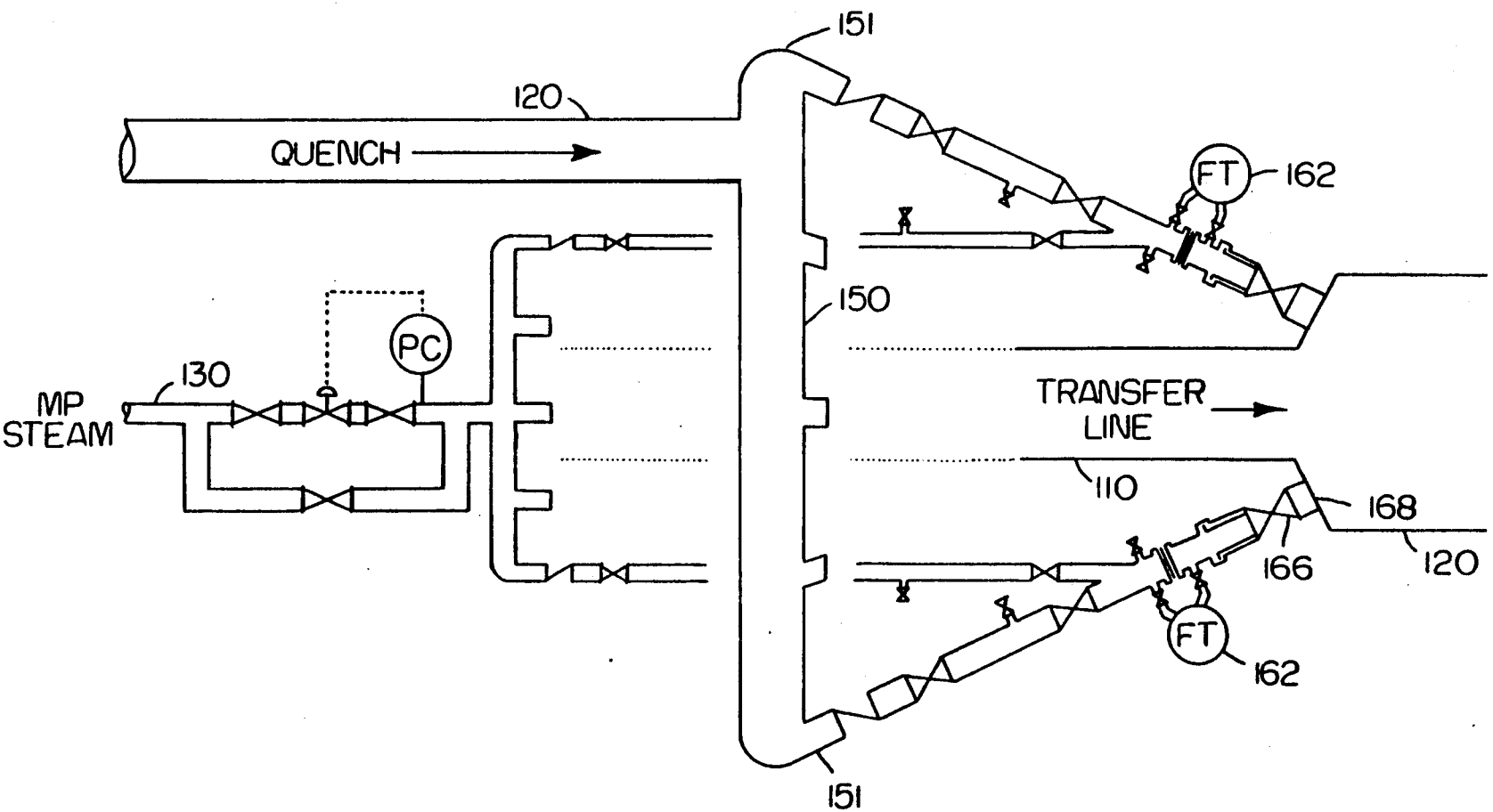
FIG. 3 is a simplified schematic view of an FCC unit of the invention, with a preferred radial sprayer quench zone in the transfer line from the reactor outlet to the main column.

FIG. 3 shows a preferred arrangement. A preferred, but not essential, radially distributed nozzle configuration is shown. Superheated reactor vapors in transfer line 110 pass into the enlarged downstream portion 120, having an enlarged diameter relative to the upstream portion 110. Region 50 of FIG. 2 corresponds to enlarged downstream portion 120.

Quench liquid is added via line 120 and distributor 150 and lines 151, with atomizing steam added via line 130. Flow transmitters 162 allow monitoring of each quench spray, so that nozzles which plug may be removed and cleaned. A two phase mixture is sprayed from 3 or more nozzles 168 radially distributed about the enlarged portion defined by the enlargement 120 of the transfer line. Full cone spray nozzles are preferred, with the outermost edge of the spray cone being parallel too, or preferably slightly away from the sidewall 120. This minimizes direct impingement of nozzle spray on the walls of the transfer line.

The enlarged transfer line reduces or eliminates coking on the sidewalls of enlarged transfer line 120. Enlarging the line, and adding quench spray as shown in the FIG. 3, ensures that the hot cracked vapor in line 110 will be completely quenched before the hot vapor, and added quench liquid, can contact the walls 120. If the transfer line was not enlarged, there is a possibility of some coke buildup occurring, because the walls of the transfer line 110 are at about the same temperature as the hot vapor flowing through the line. If any liquid is deposited on these hot metal surfaces it can coke. Enlarging the transfer line, as shown in FIG. 3, allows the walls of the transfer line 120 to run at a cooler temperature, so coking can be avoided.

The ratio of the cross sectional area of the enlarged quench region to the transfer line is critical. The quench region should have a cross sectional area at least 25% greater than the transfer line at the reactor outlet. Preferably the quench region has a cross sectional area at least 50% greater, and most preferably at least 100% greater. Preferably the transfer line and quench region are radially aligned, and cone spray means spray quench liquid cocurrently with vapor flow and within the region of fluid flow defined by the diameter of the transfer line.

Now that the invention has been briefly reviewed in conjunction with the review of the Figures, a more detailed discussion of feed, catalyst, and equipment will be presented.

FCC FEED

Any conventional FCC feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650° F.

The most uplift in value of the feed will occur when at least 10 wt %, or 50 wt % or even more of the feed has a boiling point above about 1000° F., or is considered non-distillable.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1-12, and typified by ZSM-5, and other materials having a similar crystal structure), adsorb SOX (alumina), remove Ni and V (Mg and Ca oxides).

Preferred shape selective zeolite additives are those crystalline materials having a Constraint Index of 1-12. ZSM-5 is especially preferred. Details of the Constraint Index test procedures are provided in J. Catalysis 67, 218-222 (1981), U.S. Pat. No. 4,016,218 and in U.S. Pat. No. 4,711,710 (Chen et al), which are all incorporated by reference.

Preferred shape selective crystalline materials are exemplified by ZSM-5, ZSM-11, ZSM-12, ZSM-23, ZSM-35, ZSM-48, ZSM-57 and similar materials.

ZSM-5 is described in U.S. Pat. No. 3,702,886, U.S. Reissue No. 29,948 and in U.S. Pat. No. 4,061,724 (describing a high silica ZSM-5 as "silicalite").

ZSM-11 is described in U.S. Pat. No. 3,709,979.
ZSM-12 is described in U.S. Pat. No. 3,832,449.
ZSM-23 is described in U.S. Pat. No. 4,076,842.
ZSM-35 is described in U.S. Pat. No. 4,016,245.
ZSM-38 is described in U.S. Pat. No. 4,046,859.
ZSM-48 is described in U.S. Pat. No. 4,350,835.
These patents are incorporated herein by reference.

Zeolites in which some other framework element is present in partial or total substitution of aluminum can be advantageous. Elements which can be substituted for part of all of the framework aluminum are boron, gallium, zirconium, titanium and trivalent metals which are heavier than aluminum. Specific examples of such catalysts include ZSM-5 and zeolite beta containing boron, gallium, zirconium and/or titanium. In lieu of, or in addition to, being incorporated into the zeolite framework, these and other catalytically active elements can also be deposited upon the zeolite by any suitable procedure, e.g., impregnation.

Preferably, relatively high silica shape selective zeolites are used, i.e., with a silica/alumina ratio above 20/1, and more preferably with a ratio of 70/1, 100/1, 500/1 or even higher.

Preferably the shape selective zeolite is placed in the hydrogen form by conventional means, such as exchange with ammonia and subsequent calcination.

Good additives for removal of SOx are available from several catalyst suppliers, such as Davison's "R or Katalistiks International, Inc.'s "DeSox."

CO combustion additives are available from most FCC catalyst vendors.

The FCC catalyst composition, per se, forms no part of the present invention.

CRACKING REACTOR CONDITIONS

Conventional catalytic cracking conditions may be used, in either a moving bed or fixed bed cracking unit. Fluidized catalytic cracking, especially riser cracking FCC units are preferred. Typical FCC riser cracking reaction conditions include catalyst/oil ratios of 0.5:1 to 15:1 and preferably 3:1 to 8:1, and a catalyst contact time of 0.5-50 seconds, and preferably 1-20 seconds, and riser top temperatures of 900° to about 1050° F.

The process of the present invention tolerates and encourages use of unconventional reactor conditions. Riser top temperatures of 1100° F., 1150° F., 1200° or even higher can be tolerated in the process of the present invention, and are preferred when the feed is heavy, and contains 10% or more of resid. Unusually short riser residence times are possible at such high temperatures, so riser hydrocarbon residence times of 0.1 to 5 seconds may be used., e.g., 0.2 to 2 seconds.

It is preferred, but not essential, to use an atomizing feed mixing nozzle in the base of the riser reactor, such as ones available from Bete Fog. More details of use of such a nozzle in FCC processing is disclosed in U.S. Ser. No. 229,670, which is incorporated herein by reference.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al.

It is preferred, but not essential, to use a hot catalyst stripper. Hot strippers heat spent catalyst by adding some hot, regenerated catalyst to spent catalyst.

The FCC reactor and stripper conditions, per se, can be conventional. In many refineries, the existing reactor and stripper can be left untouched, and the unit modified by adding a quench zone to the transfer line intermediate the vapor outlet from the reactor section and the main column.

CATALYST REGENERATION

The process and apparatus of the present invention can use conventional TCC or FCC regenerators.

Preferably a high efficiency regenerator, such as is shown in the Figures, is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multi-stage regenerators, etc. The regenerator, per se, forms no part of the present invention. In most units, the existing regenerator will be used to practice the present invention.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. Pt can be replaced by other metals, but usually more metal is then required. An amount of promoter which would give a CO oxidation activity equal to 0.3 to 3 wt. ppm of platinum is preferred.

Conventionally, refiners add CO combustion promoter to promote total or partial combustion of CO to CO2 within the FCC regenerator. More CO combustion promoter can be added without undue bad effect—the primary one being the waste of adding more CO combustion promoter than is needed to burn all the CO.

The present invention can operate with extremely small levels of CO combustion promoter while still achieving relatively complete CO combustion because the heavy feeds contemplated for use herein will usually deposit large amounts of coke on the catalyst, and give extremely high regenerator temperatures.

COMPARISON OF ESTIMATED YIELDS

The benefits of practicing the present invention can most easily be seen by comparing the yields obtainable in a conventional, prior art FCC unit versus an estimate of the yields obtainable in the same unit by adding a quench zone to the transfer line, as close as possible to the riser reactor outlet, cyclones, etc.

ESTIMATE 1—PRIOR ART

The prior art unit estimate is based on yields obtainable in a conventional FCC unit operating with a riser reactor, a high efficiency regenerator, and a conventional catalyst stripper.

The reactor conditions included:

Riser Top Temperature=1000° F.

Riser Top pressure=32 psig

Cat:Oil Weight Ratio=6.5:1

The reactor discharged into a plenum having a volume of 2,154 cubic feet. The transfer line had a volume of 3,291 cubic feet, and was about 225 feet of 54" OD line.

The feed a specific gravity of 0.9075.

Under these conditions, the unit achieved a 76.11 vol % conversion of feed.

The following yield estimate is presented in three parts. The first or base case is with no changes. The second eliminates the plenum, but does not quench. The third (invention) eliminates the plenum and quenches the reactor effluent vapor within 10 or 20 feet of the reactor outlet, to a temperature of 700°-800° F. using a heavy quench liquid such as LCO, HCO or Main Column Bottoms injected at about 520° F. through an in-line peripheral nozzle arrangement.

TRANSFER LINE QUENCHING STUDY

| CASE: | BASE | NO PLENUM | QUENCH |
|---|---|---|---|
| Conversion, Vol. % - = | 76.11 | −0.10 | −0.23 |
| Gasoline Yield, Vol % | 58.12 | 0.16 | 0.39 |
| Gasoline Octane, RONCL | | −.09 | −0.31 |
| C2 and lighter wt % | 4.22 | −0.10 | −0.08 |
| C3 + C4 olefins, vol % | 15.06 | −0.15 | −0.37 |
| iC4 vol % | 5.32 | 0.01 | 0.02 |
| Light Fuel Oil | 18.27 | 0.16 | 0.39 |
| Heavy fuel Oil | 5.62 | −0.06 | −0.16 |
| G + D vol % | 76.39 | 0.32 | 0.80 |
| Coke (weight %) | 5.12 | 0 | 0 |

This shows a decrease in thermal cracking. The ERT, or equivalent reaction time at 800° F. in the transfer line has been significantly reduced. This reduction in thermal cracking increases yields of valuable liquid product, and improves product quality. There is a slight decrease in gasoline octane number because thermal cracking produces olefinic gasoline which has a good octane number. Thermal cracking also reduces yields of gasoline The process of the invention (eliminating the reactor plenum, and quenching in the transfer line) increases G+D yields, or gasoline plus distillate yields, by about 0.80 vol %. In the commercially sized unit which was the basis for this study, processing 96.5 thousand barrels per day of feed, the practice of the present invention results in an increase of 772 barrels of gasoline and distillate product.

The process and apparatus of the present invention will allow higher riser top temperatures to be used, and these higher reactor top temperatures will lead to several other benefits which will occur in practice, but are not reflected in the above yield estimates.

Vaporization of all feeds, and especially of resids, is favored by higher reactor temperatures. Much of the base of the riser is devoted to vaporizing the feed, and operating with higher riser temperatures allows more of the riser to be used for vapor phase cracking, rather than vaporization of liquid.

Higher riser top temperatures allow more heat to be removed from the FCC unit with the cracked products. Less heat must be removed in the regenerator. This helps to keep the unit in heat balance. This heat is eventually recovered in downstream fractionators or heat exchangers.

Catalyst stripping will be slightly better at higher temperatures, so higher riser top temperatures will improve somewhat the stripping operation.

If practicing the invention today, we would quench in the transfer line using eight nozzles spaced 45 degrees apart around the transfer line periphery. We would use nozzles from Bete Fog, which produce a 60 degree full cone spray pattern. These nozzles would be installed so that one side of the cone is parallel angled slightly away from the pipe wall. Steam on pressure control will be injected upstream of the nozzles to maintain design pressure drop and ensure good atomization. Provisions should be made to allow nozzles to be blocked in individually to conserve steam usage. Packing glands with steam purge sleeves will allow for nozzle removal and servicing.

Addition of enough quench liquid to condense some of the cracked heavy product will largely eliminate thermal cracking, but may cause some problems with two phase flow in the transfer line. Adding just enough quench liquid to quench, but not condense, cracked product will ensure one phase flow in the transfer line, but the higher temperatures may cause coking in some installations. Complete quenching, with some condensation, will usually be preferred.

It will be beneficial in many units to widen the transfer line at the point of quench injection. Thus the downstream portion of the quench line could have an enlarged diameter relative to the upstream portion.

The transfer line is enlarged to reduce or eliminate the amount of coking that occurs on the sidewalls of enlarged transfer line. Enlarging the line, and adding quench spray so that the nozzles spray no closer than parallel to the transfer line walls ensures that the hot cracked vapor in the transfer line will be completely quenched before the hot vapor, and added quench liquid, can contact the walls. If the transfer line was not enlarged, there is a possibility of some coke buildup occurring, because the walls of the transfer line are at about the same temperature as the hot vapor flowing through the line. If any liquid is deposited on these hot metal surfaces it can coke. Enlarging the transfer line allows the walls of the downstream portions of the transfer line to run at a cooler temperature, so coking can be avoided.

It may also be beneficial in some units to use a quench zone lined with a relatively non-sticking material, such as a ceramic coating, or Teflon, or some other material which does not provide coke deposits a place to grow.

We claim:

1. In a fluidized catalytic cracking process wherein a heavy hydrocarbon feed comprising hydrocarbons having a boiling point above about 650° F. is catalytically cracked to cracked products comprising the steps of:

a. catalytically cracking said feed in a catalytic cracking zone operating at a riser top temperature of 900° to 1200° F., catalyst/oil ratios of 0.5:1 to 15:1, and catalyst contact times of 0.1 to 50 seconds, by contacting said feed with a source of hot regenerated cracking catalyst to produce a cracking zone effluent mixture having an effluent temperature of 900° to 1200° F. and comprising cracked products and spent cracking catalyst containing coke and strippable hydrocarbons;

b. separating said cracking zone effluent mixture into a cracked product vapor phase having a temperature above 900° F. and a spent catalyst rich phase;

c. stripping and regenerating said spent catalyst to produce regenerated catalyst which is recycled to crack heavy feed;

d. transferring said cracked product vapor from said catalytic cracking zone to a main fractionator which recovers liquid product fractions from said cracking zone effluent via a transfer line having a cross sectional area and an upstream portion near said cracking zone and a downstream portion near said main fractionator at a transfer line temperature above 900° which is sufficient to cause thermal cracking of said cracked vapor product in said transfer line;

e. quenching in a quench zone, comprising a portion of the transfer line having a cross sectional area at least 25% greater than the cross sectional area of the transfer line near said cracking zone, in the upstream portion of said transfer line said cracked product vapor by injection of a liquid product fraction recycled from said main fractionator into said transfer line in an amount and at a temperature sufficient to reduce the temperature of the cracked product vapor in said transfer line by at least 30° F. and to vaporize at least 90% of the injected product liquid, wherein the amount of thermal cracking, as measured by Equivalent Reaction Time at 800° F., in said transfer line is reduced by at least 50%.

2. The process of claim 1 wherein essentially all of the material in the transfer line is maintained in the vapor phase.

3. The process of claim 1 wherein the thermal cracking in the transfer line is reduced by at least 75%.

4. The process of claim 1 wherein the quench liquid is sprayed into the transfer line through at least one spray nozzle.

5. The process of claim 1 wherein the quench liquid is an aromatic hydrocarbon stream derived from the main column and selected from the group of naphtha, light cycle oil, heavy cycle oil, main column bottoms, and mixtures thereof.

6. The process of claim 1 wherein the quench liquid is cooled by heat exchange prior to injection into the quench zone.

7. The process of claim 1 wherein the reactor cracked product vapor has a temperature of at least 1000° F., the quench zone liquid is selected from the group of light cycle oil, heavy cycle oil and main column bottoms, and is injected at a temperature of about 500°-600° F. to produce a quench zone effluent temperature of about 700°-800° F.

8. The process of claim 1 wherein sufficient quench liquid is added to the transfer line to condense at least a portion of the vapor product in said transfer line.

9. The process of claim 1 wherein the thermal cracking in the transfer line is reduced by at least 90%.

10. The process of claim 1 wherein the quench zone has a cross sectional area at least 50% greater than the cross sectional area of the transfer line near said cracking zone.

11. The process of claim 1 wherein the quench zone has a cross sectional area at least 100% greater than the cross sectional area of the transfer line near said cracking zone.

12. An apparatus for the fluidized catalytic cracking of a heavy hydrocarbon feed comprising hydrocarbons having a boiling point above about 650° F. to lighter products by contacting said feed with catalytic cracking catalyst comprising:

a. a catalytic cracking riser reactor means having an inlet in a lower portion of the riser connective with a source of said feed and with a source of regenerated catalyst and having an outlet at an upper portion of the riser for discharging a cracking zone effluent mixture comprising cracked products and spent cracking catalyst;

b. a separation means within a vessel containing the riser reactor outlet adaptive to separate said cracking zone effluent mixture into a cracked product vapor phase which is removed from said vessel via a vessel vapor outlet and a spent catalyst rich phase which is conveyed to a stripping means;

c. a stripping means for stripping spent catalyst which is operatively connected with said separation means for admission of spent catalyst and discharges a stream of stripped catalyst;

d. a catalyst regeneration means connective with said stripping means for regenerating the stripped catalyst to produce regenerated catalyst and comprising means for recycling regenerated cracking catalyst to the base of the riser reactor;

e. a transfer line having a cross sectional area and an upstream portion connective with the vessel cracked product vapor outlet and a downstream portion connective with a main fractionator means for transfer of cracked vapor to a main fractionator means for fractionation and recovery of liquid streams of cracked products;

f. a quench means located within the upstream portion of the transfer line, said quench means comprising a portion of the transfer line having a cross sectional area at least 25% greater than the cross sectional area of the transfer line near said cracking zone, and further comprising means for injection of at least one quench liquid stream from the main fractionator into said transfer line whereby cracked products removed from the vessel vapor outlet are contacted with quench liquid from the main fractionator in said quench region having an enlarged cross sectional area.

13. The apparatus of claim 12 wherein an indircet heat exchange means is provided on the quench liquid line from the main fractionator whereby liquid product from said main fractionator is cooled via indirect heat exchange prior to injection into said injection line.

14. The apparatus of claim 12 wherein the quench zone has a cross sectional area at least 50% greater than the cross sectional area of the transfer line near said cracking zone.

15. The apparatus of claim 12 wherein the quench zone has a cross sectional area at least 100% greater than the cross sectional area of the transfer line near said cracking zone.

16. The apparatus of claim 12 wherein the transfer line upstream of the quench region has a diameter, said transfer line and quench region are radially aligned, and cone spray means are provided adaptive to spray quench liquid cocurrently with vapor flow and within the region of fluid flow defined by the diameter of the transfer line.

* * * * *